US006687660B2

(12) United States Patent
Robinson et al.

(10) Patent No.: US 6,687,660 B2
(45) Date of Patent: Feb. 3, 2004

(54) HYDROCARBON RESERVOIR TESTING

(75) Inventors: James Robinson, Glanmire (IE); John Campbell, Ballinhassig (IE)

(73) Assignee: Kepler Research & Development Limited, Glanmire (IE)

( * ) Notice: Subject to any disclaimer, the term of this patent is extended or adjusted under 35 U.S.C. 154(b) by 135 days.

(21) Appl. No.: 09/882,437

(22) Filed: Jun. 14, 2001

(65) Prior Publication Data

US 2001/0056339 A1 Dec. 27, 2001

Related U.S. Application Data

(63) Continuation of application No. PCT/IE99/00131, filed on Dec. 15, 1999.

(30) Foreign Application Priority Data

Dec. 16, 1998 (IE) ..... S981061

(51) Int. Cl.[7] ..... G06G 7/48
(52) U.S. Cl. ..... 703/10; 702/6; 702/13
(58) Field of Search ..... 703/10; 367/72; 702/6, 13

(56) References Cited

U.S. PATENT DOCUMENTS

| | | | | |
|---|---|---|---|---|
| 4,803,873 A | | 2/1989 | Ehlig-Economides | 73/155 |
| 4,821,164 A | * | 4/1989 | Swanson | 702/5 |
| 5,033,546 A | | 7/1991 | Combe | 166/245 |
| 5,305,209 A | | 4/1994 | Stein et al. | 364/420 |
| 6,018,497 A | * | 1/2000 | Gunasekera | 367/72 |
| 6,106,561 A | * | 8/2000 | Farmer | 703/10 |

FOREIGN PATENT DOCUMENTS

WO WO99/57418 11/1999

OTHER PUBLICATIONS

AutoCAD and its applications, by Terence M. Schumaker et al., Autodesk, May 1998, ISBN 1566374146, p. 228–230.*
The Computer Science and Engineering Handbook, by Allen B. Tucker, CRC Press, ISBN: 0–8493–2909–4, 1996, pp. 1216, 1520, 1542–1543, 1587–1588, 1652.*
A Hybrid System for Well Test Analysis, by E. A. May et al., 1998 IEEE, p. 295–300.*
Database INSPEC, May et al, "A hybrid system for well test analysis", 1998, Institute of Electrical Engineers.

* cited by examiner

*Primary Examiner*—Kevin J. Teska
*Assistant Examiner*—Ed Garcia-Otero
(74) *Attorney, Agent, or Firm*—Jacobson Holman PLLC

(57) ABSTRACT

A reservoir in payrock in analysed using finite element simulation. A reservoir engineer selects an appropriate model from a set of template models, each including a set of polygons in plan and layers in elevation. The polygons are defined in objects instantiated from classes by control points and the layers as depth values of control points. A pattern object sweeps rotationally about a wellbore in a wellbore polygon to define a pattern of elements, fewer in number with distance from the wellbore. A polygon object also sweeps linearly from a generator line in the direction of a base line. The generator and base lines correspond to polygon boundaries. Finite element simulation is performed with the model so derived.

17 Claims, 7 Drawing Sheets

HYDROCARBON RESERVOIR TESTING

This is a Continuation Application of PCT International Application No. PCT/IE99/00131, filed Dec. 15, 1999.

INTRODUCTION

1. Field of the Invention

The invention relates to well testing of hydrocarbon reservoirs to determine economic viability.

The purpose of reservoir simulation is to determine as precisely as possible the extent (volume), nature, permeability, and porosity of the payrock.

2. Prior Art Discussion

In well testing a wellbore is drilled into the payrock, usually at an angle to vertical. The wellbore is lined and the lining is perforated at locations within the payrock. Oil or gas in the payrock flows into the wellbore through these perforations and the pressure arising from his flow is measured by pressure gauges within the wellbore. Flow of oil or gas from the wellbore opening is controlled by pumps and valves at the opening.

For simulation, the hydrocarbon stock which flows from the wellbore is analysed and parameters such as the compressibility and the viscosity are determined. Also, geological surveys are performed. The combined information so gathered is used to estimate the payrock properties. These properties are used by a simulation tool to estimate the pressure curve (as a function of time). The estimated curve is fed back to change the input payrock properties in an iterative manner until the estimated pressure curve matches closely the actual measured curve. The particular payrock properties for this iteration stage should be reasonably accurate.

While this method is quite sound in its reasoning, it suffers from a major drawback. This is an inaccuracy which arises because of use of crude representations of the payrock geometry and material properties. If the geometry and material distribution data is very inaccurate, the overall analysis is generally compromised.

OBJECTS OF THE INVENTION

The invention is therefore directed towards addressing this problem by providing for more accurate simulation with less engineer time requirement.

SUMMARY OF THE INVENTION

According to the invention, there is provided a hydrocarbon reservoir analysis method comprising the steps of simulating hydrocarbon flow from the reservoir into a wellbore and analysing simulated wellface pressure response by comparing it with measured pressure data, characterised in that the reservoir is modelled before simulation as a solid model comprising polygons in plan and layers in elevation, finite elements are generated in patterns in the polygons and the layers to provide a mesh, and simulation is performed with said mesh.

In one embodiment, the method comprises the further step of selecting an appropriate template model from a set of template models and modifying the selected model.

In one embodiment, the selected model is modified by changing the numbers of layers and the shapes of the polygons.

In one embodiment, the polygon shapes are modified by changing locations of control points at polygon corners and the number of layers is changed by changing depth data associated with said control points.

In one embodiment, the model is represented by objects instantiated from classes.

In one embodiment, the model is represented by:

a shape object defining the overall reservoir shape;

a polygon object defining each polygon in terms of an aerial region in plan bounded by edges defining vertical planes; and a layer object defining each layer in terms of the bounding planes above and below.

In one embodiment, the mesh is generated by generating a pattern object defining elements extending in an elevational plane.

In one embodiment, a pattern object defines elements in a plane extending radially from the wellbore for a wellbore polygon.

In one embodiment, the plane extends from the wellbore to the polygon edges.

In one embodiment, the pattern object defines progressively fewer elements as it extends from the wellbore.

In another embodiment, the pattern object is swept rotationally from a starting plane extending radially from the wellbore to fill the polygon containing the wellbore.

In one embodiment, a pattern object is swept translationally from a starting plane corresponding to a generator line and defines elements in a direction extending from the generator line in the direction of an adjoining base line.

In one embodiment, the base line and the generator line coincide with polygon boundaries.

In one embodiment, the base and generator lines are defined as such in the shape object, and each pattern object is related to the polygon objects and the shape object according to a condition that each polygon comprises at least one base line and at least two generator lines.

In one embodiment, the pattern objects are inter-related in a manner whereby they are ranked according to their relationship with the wellbore polygon.

In one embodiment, the wellbore polygon has a first rank level, polygons adjoining the wellbore polygon have a second rank level, polygons adjoining the second rank polygons have a third rank level, and subsequent polygons are ranked accordingly.

In one embodiment, each pattern object defines elements according to facets linking layer bounding planes.

In one embodiment, the simulation is performed according to algorithms which inextricably couple finite element mesh generation, material property assignment. and equation solving.

In one embodiment, variable precedence data required for equation solution is inferred and constructed within mesh generation.

In one embodiment, the simulation imposes boundary conditions on parts of the wellbore, leading to a set of pressure equality constraints used to re-map the precedence data to reduce computation time.

In one embodiment, the simulation step comprises the sub-steps of representing time step history, minimum dimensionless pressure, and maximum dimensionless pressure as lines in a pressure/time graph providing controls for a colour range, and receiving input instructions in the form of movement of said lines to a desired position.

According to another aspect, the invention provides a hydrocarbon reservoir analysis system comprising means for performing a method as defined above.

DETAILED DESCRIPTION OF THE INVENTION

BRIEF DESCRIPTION OF THE INVENTION

The invention will be more clearly understood from the following description of some embodiments thereof, given by way of example only with reference to the accompanying drawings in which.

Figure 4A:
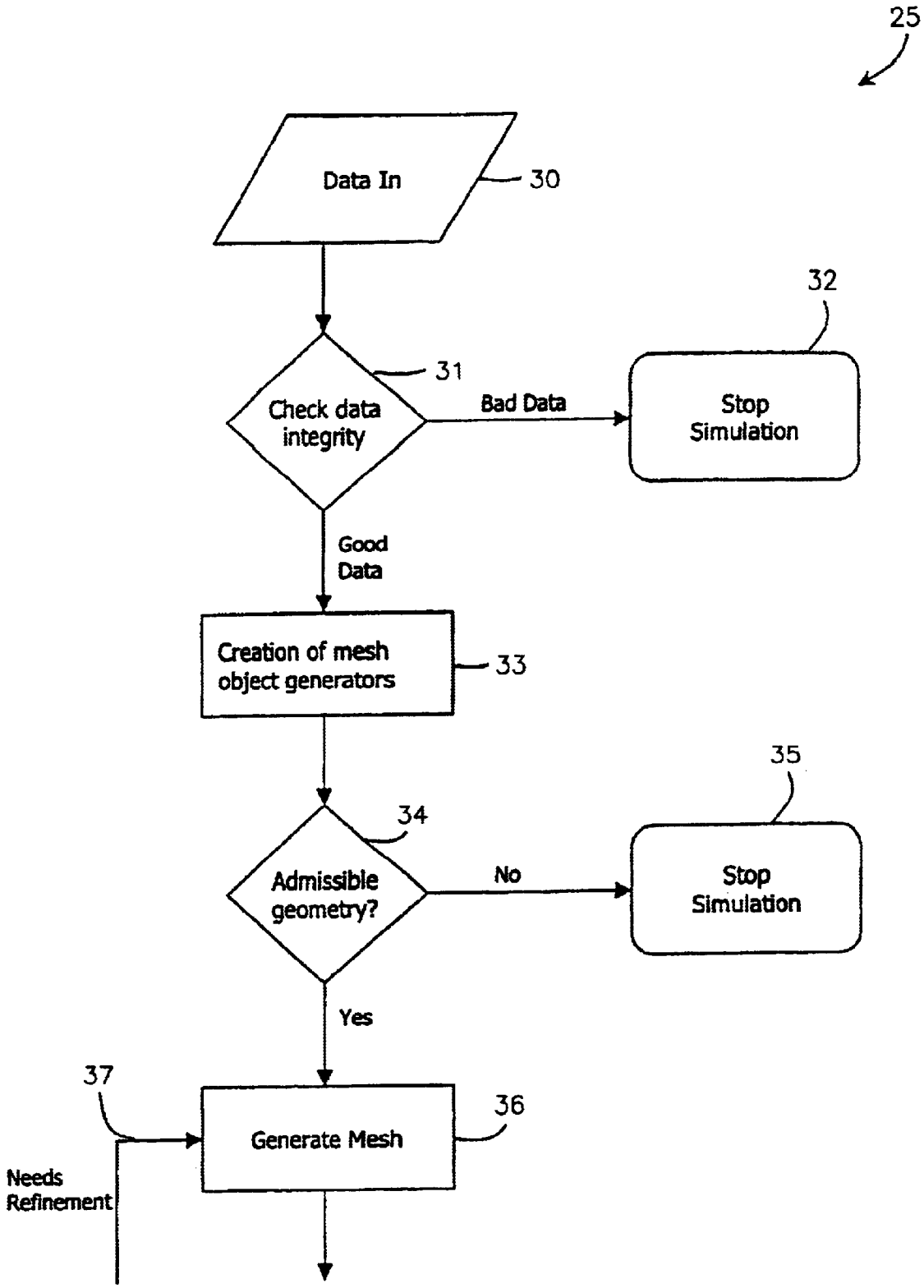
Figure 4B:
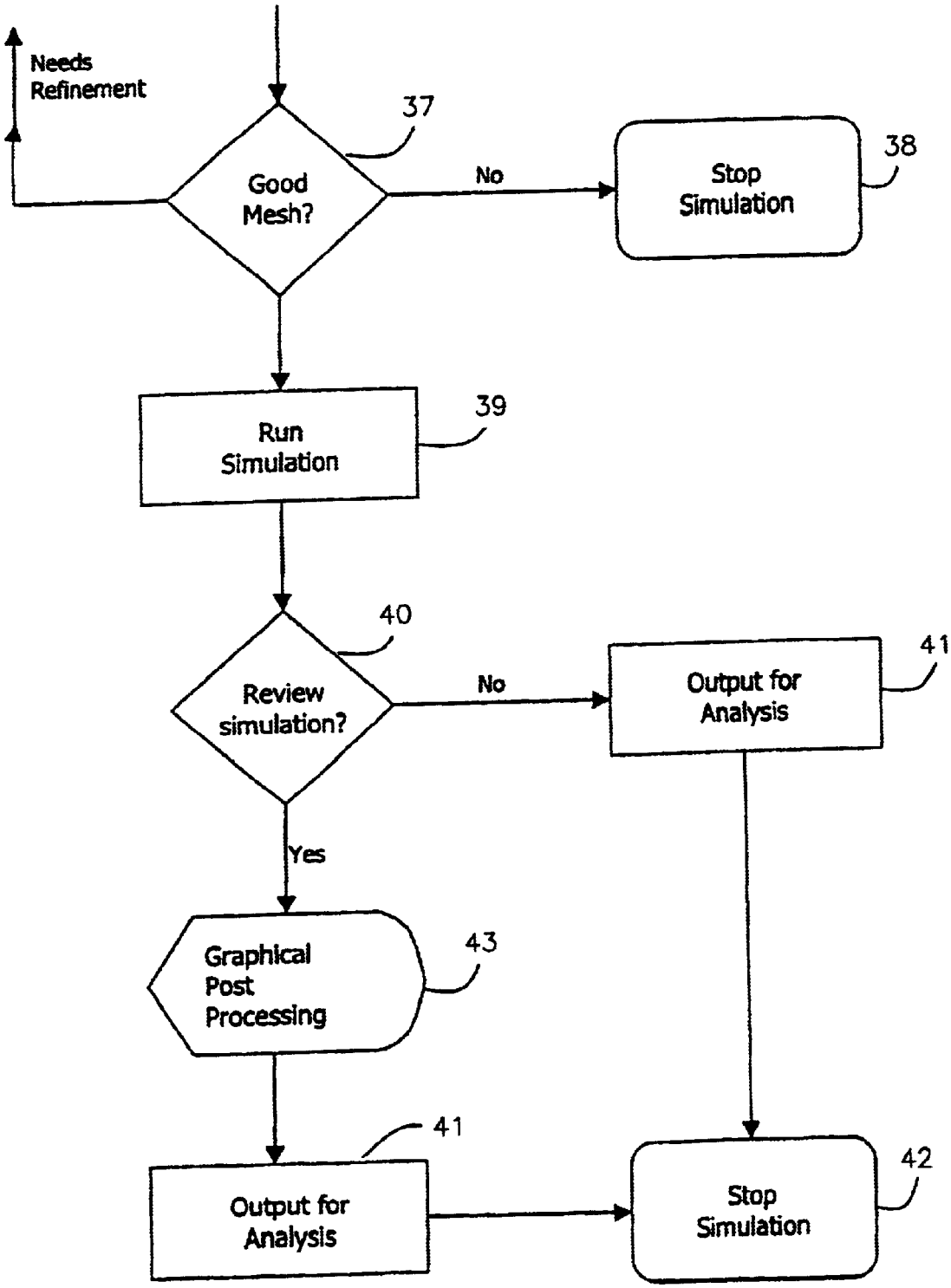
Figure 5A:
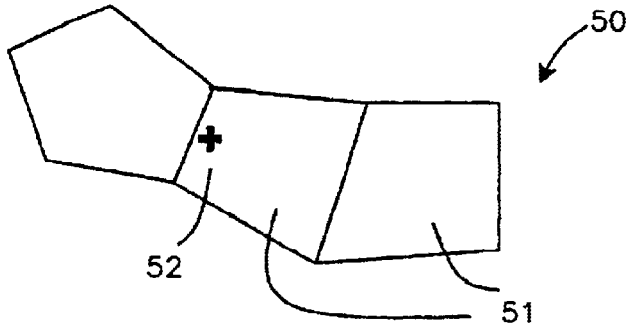
Figure 5B:
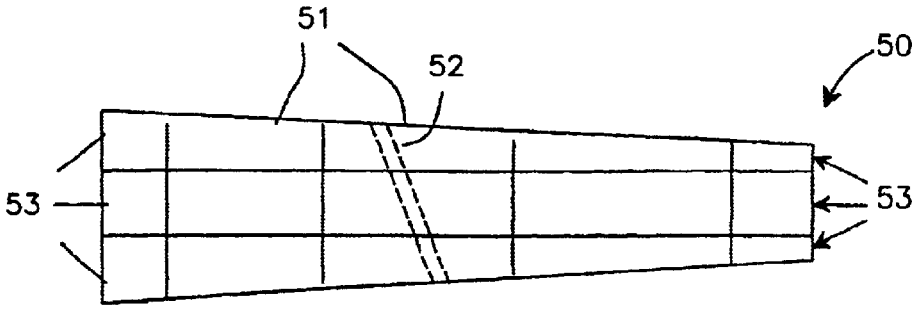

FIGS. 4(*a*) and 4(*b*) are together a flow diagram illustrating the simulation step in detail;

FIG. 5(*a*) is a generalised plan view of a reservoir model and

Figure 6:
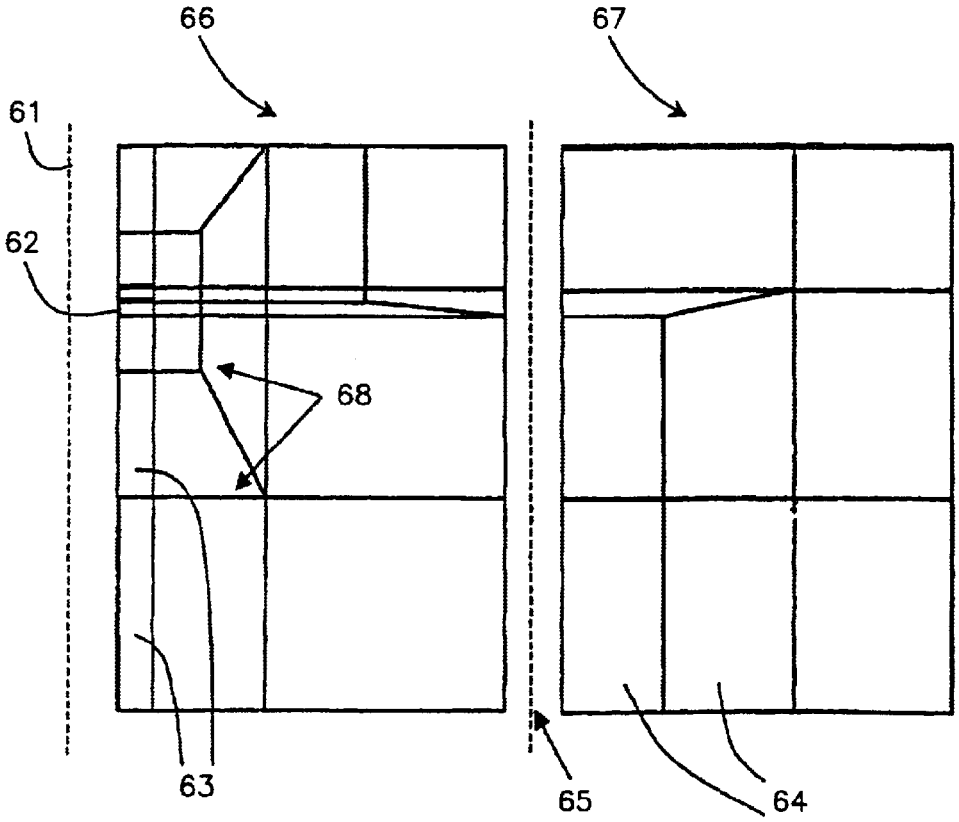
Figure 7:
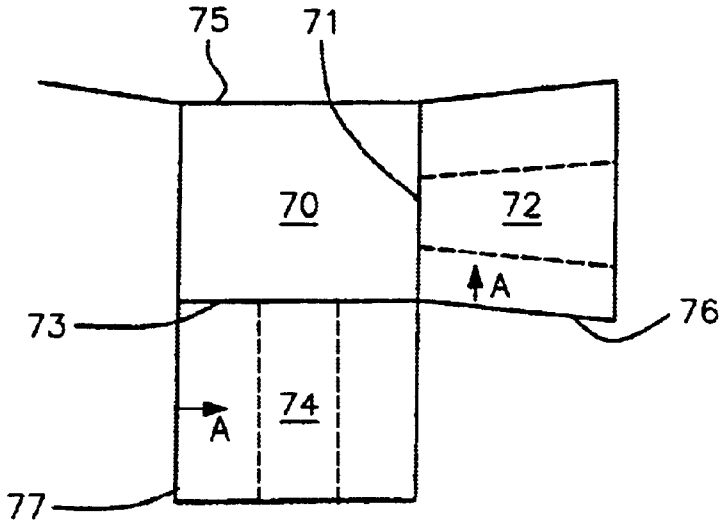
Figure 8:
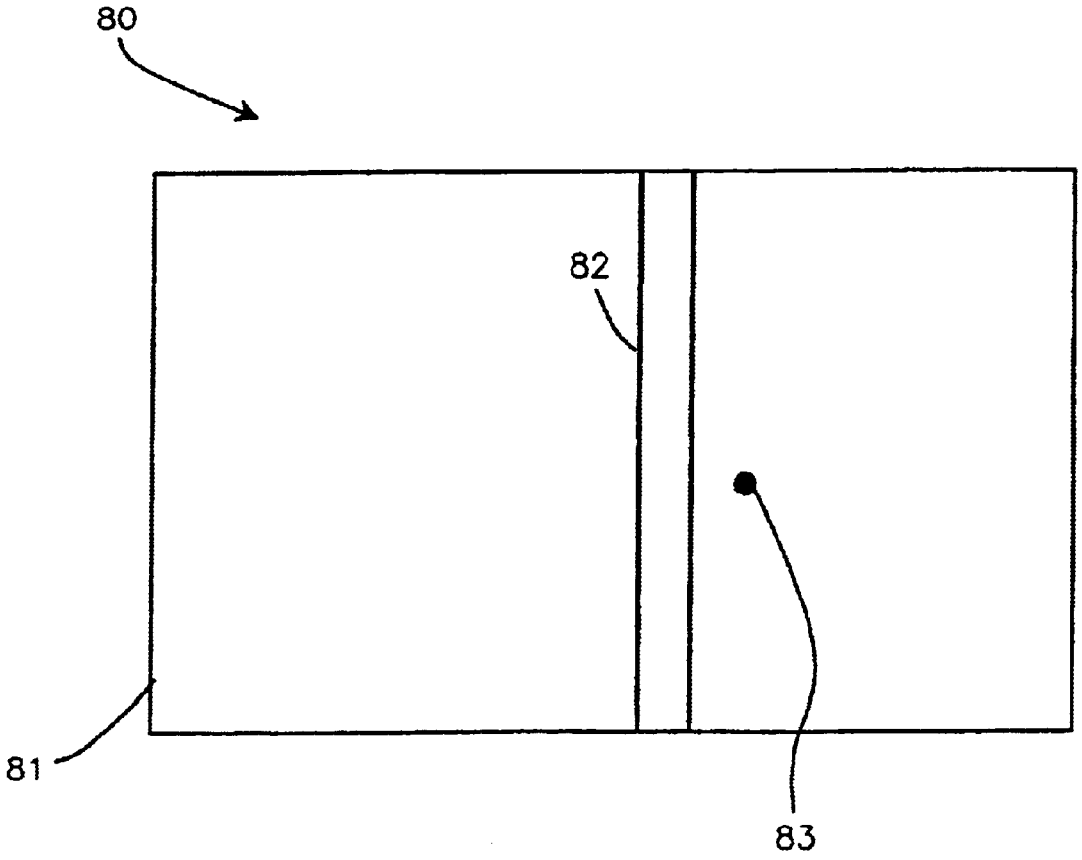
Figure 9:
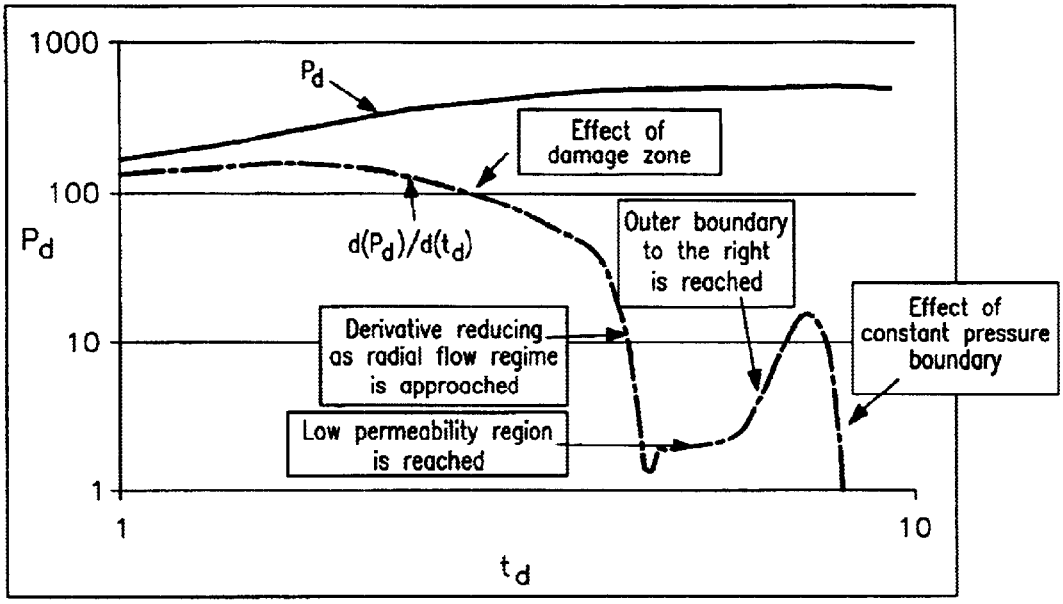
Figure 10:
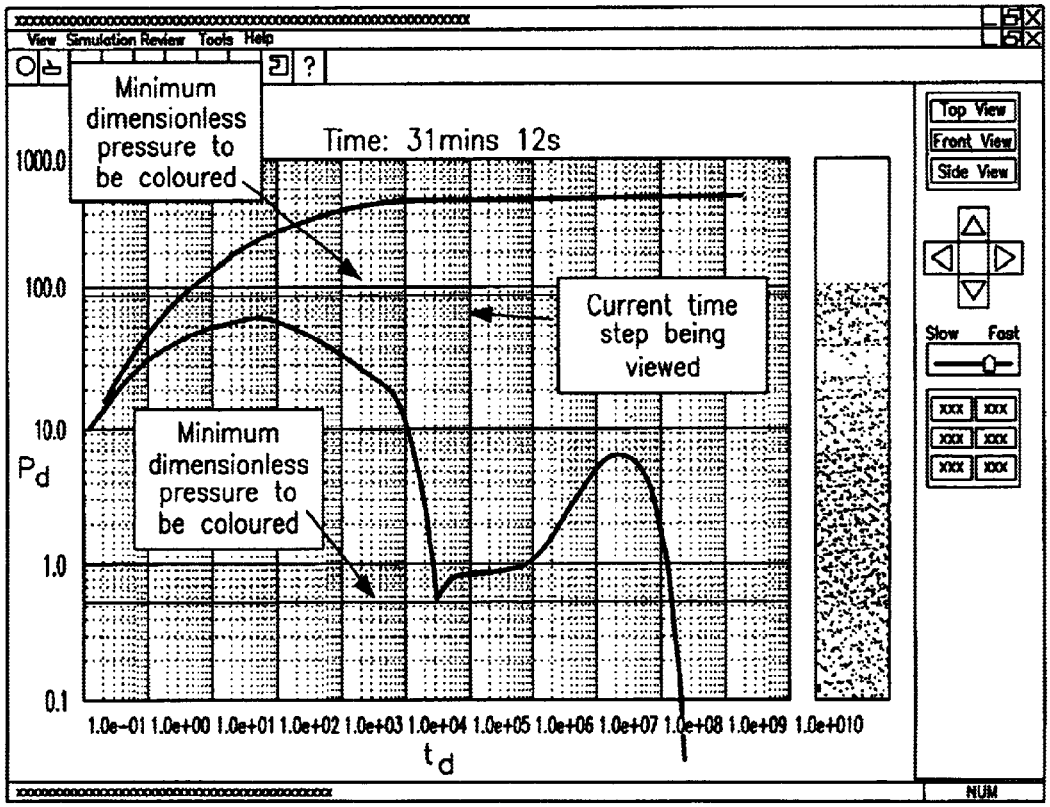

FIG. 5(*b*) is a generalised elevational view;

FIG. 6 is a vertical section of part of the model incorporating two polygons;

FIG. 7 is a diagram illustrating base and generator lines for mesh generation;

FIG. 8 is a diagram illustrating a typical reservoir and some of the aspects which are analysed using simulation results;

FIG. 9 is a sample log/log results plot showing key features of reservoir make-up; and FIG. 10 is a screen shot of a results output graph which also acts as a user interface to allow a user to control the pressure map output.

DESCRIPTION OF THE EMBODIMENTS

Figure 1:
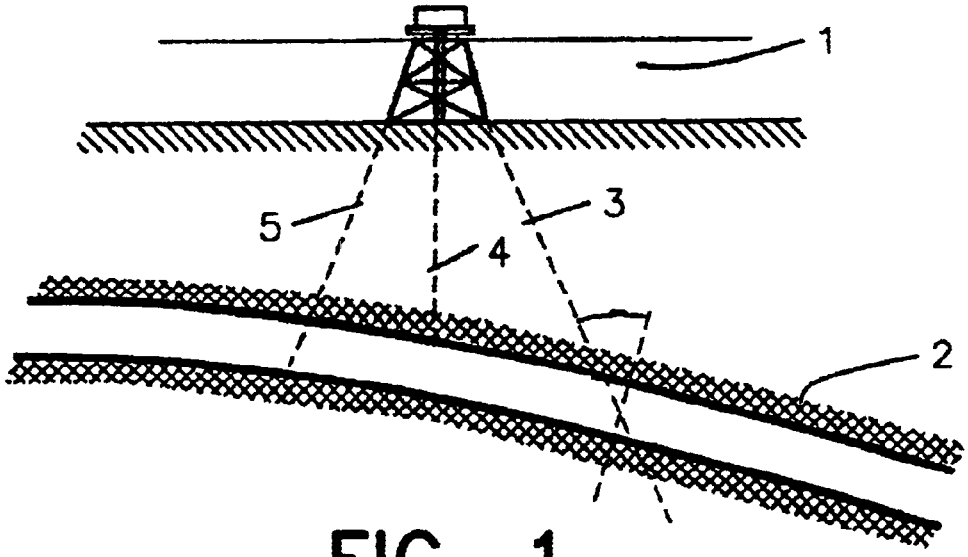
FIG. 1 is a high-level diagram showing a testing rig and a payrock.

Referring to FIG. 1, the overall context for reservoir testing is illustrated. A testing rig 1 is erected over a payrock 2 containing a reservoir of a hydrocarbon (oil or gas). A wellbore 3 is drilled at an angle into the payrock, and alternative angles 4 and 5 are shown.

Figure 2:
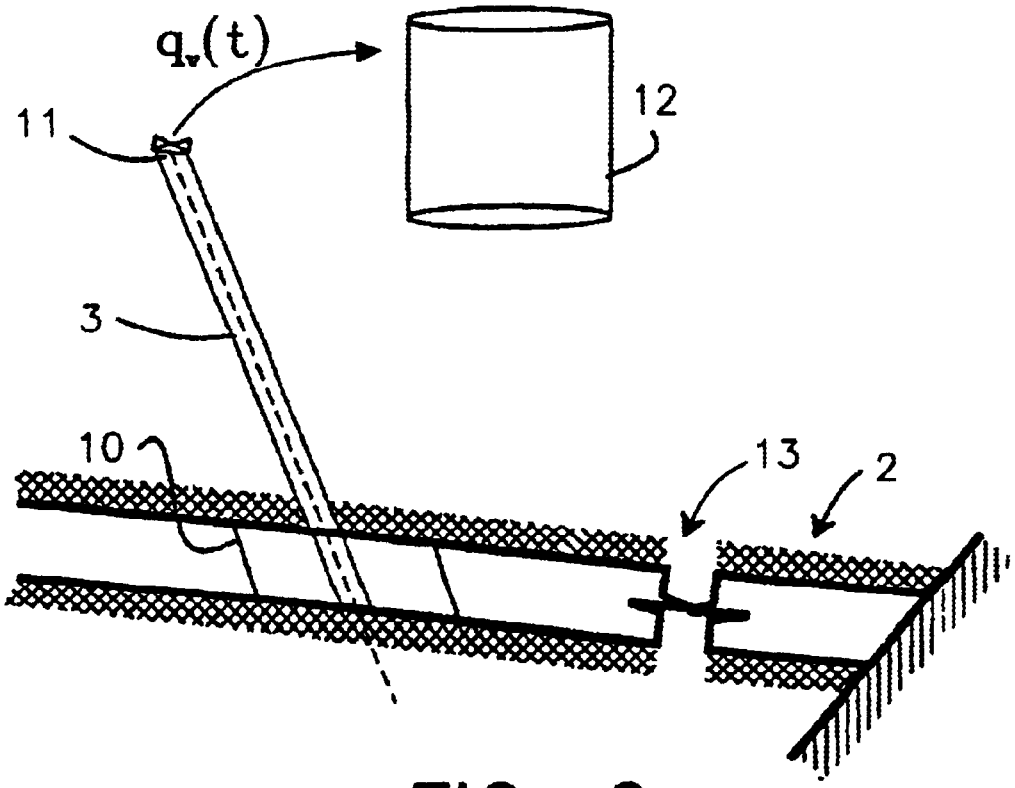
FIG. 2 is a more detailed diagram showing a wellbore and its penetration into the payrock.

As shown in FIG. 2, the part of the payrock 2 surrounding the wellbore 3 is referred to as a damaged zone 10. Oil flows through the damaged zone 10 and the lining perforations into the wellbore 3 under the reservoir pressure. A valve 11 controls flow from the top of the wellbore 3 to a stock tank 12. A fault line 13 at one end of the payrock 2 is also illustrated in this diagram. Flow from the wellbore 3 to the stock tank 12 is denoted $q_v(t)$ and wellbore storage is denoted $cV_{st}$. Various pressure sensors (not shown) are mounted within the wellbore 3 so that an actual pressure change (or curve) as a function of time can be measured.

Figure 3:
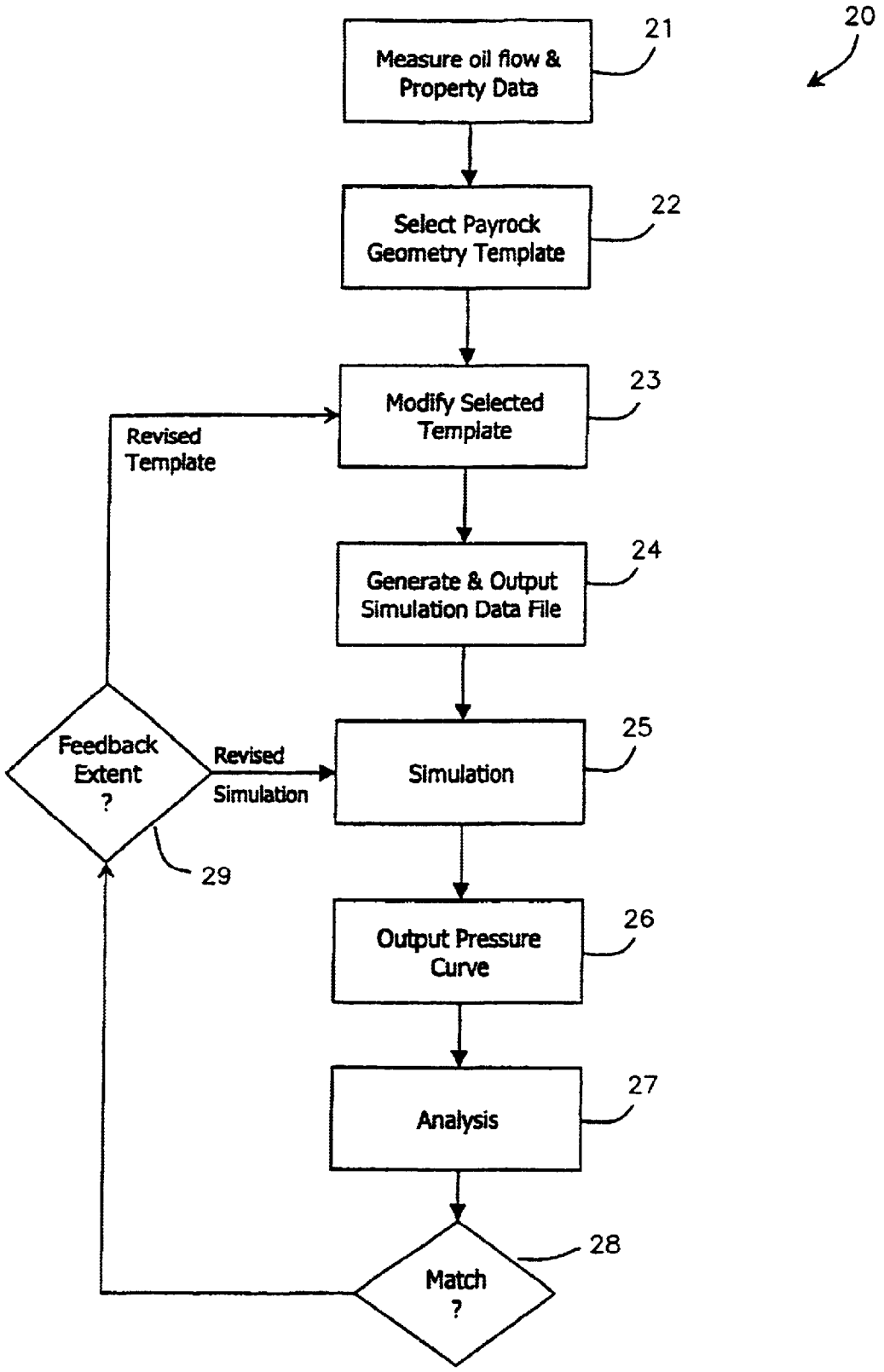
FIG. 3 is a flow diagram of a well testing method.

Referring now to FIGS. 3, 4(*a*), and 4(*b*) a method 20 for reservoir testing and analysis is described. In a step 21 oil flow is measured using the pressure sensors. This step also involves laboratory analysis of oil samples drawn from the stock tank 12.

A workstation stores a number of templates, each modelling a reservoir. A template 50 is illustrated diagrammatically in FIGS. 5(*a*) and 5(*b*). It is a solid model definition of a reservoir in terms of a number of polygons 51, at least one of which includes a wellbore 52. The template also comprises a number of layers 53 extending generally in the axial direction of the wellbore 52. Each polygon 51 is represented as an object in the computer system object-oriented paradigm, as described in more detail below. The layers are defined by objects having attributes including depth values at the polygon control points.

In step 22, an engineer selects a template 50 which most closely matches the geometry of the reservoir on the basis of the available data and his or her experience.

In step 23, a model is then created by modifying the initial template model to, for example, change the number of layers and/or the shapes of the polygons. Changing the polygon shapes is implemented in a simple manner by changing the locations of the control points (at the polygon corners). The layers are modified by changing the depth values at the control points.

A simulation data file is then created in step 24. This comprises the following.

The model (as modified).

Initial reservoir and hydrocarbon material properties such as 3D permeability, porosity, viscosity, and compressibility. Some of this data is guessed on the basis of experience and some is measured.

Mechanical skin definition: radius of damaged zone 10 and altered material properties.

Radial composite zone: radius parallel to the wellbore containing different material properties.

Wellbore geometry: plan position, inclination angle, and azimuth angle.

Completion data: number and length of completion zones.

Sand face flowrate.

Duration of test.

The data file has the following structure.

Control Points i $x_i$ $y_I$

The nodes are given in anti-clockwise order.

No. of Polygons

Area heterogeneity allows up to nine polygons in plan.

i n1 n2 n3 . . . −1

Polygon I, node (control point) 1 node2 . . . in anti-clockwise order (with a terminating −1) Polygons should have generally 3, 4 or 5 sides, but a lone polygon can have up to eight sides. Polygons should be convex, but the overall reservoir can be concave (made up of convex polygons).

No. of Layers

The layers are read in from the top down. This means that the bottom plane of the top layer is the top plane of the bottom layer and represents the "interface plane". There is a full layer data set for each layer (i.e. $a_t$ $b_t$ $c_t$ $d_t$ through to compressibility).

| | | | |
|---|---|---|---|
| $a_t$ | $b_t$ | $c_t$ | $d_t$ |
| $a_b$ | $b_b$ | $c_b$ | $d_b$ |

The top surface of the top layer is described by coefficients of the equation of the plane: i.e ax+by+cz+d=0. (e.g. xy plane is 0 0 1 0 i.e. z=0).

Flags for polygons present in this layer.

A series of binary flags to indicate if a polygon is switched on in the current layer (one for each polygon).

Damage Radius Composite Radius

Values of 0 for either of these parameters imply they don't occur in this layer. The material properties that make up this layer are given. These are given in order, radially outwards from the wellbore, i.e. damage material, material within the composite radius, material in of polygon1 material in of polygon2 . . .

Permeability $x_x$ $y_x$ $z_x$ (x'(principal axis) vector for material i permeability)

$x_y$ $y_y$ $z_y$ (y' (principal axis) vector for material i permeability.)

$k_x k_y k_x$ (Principal axes permeabilities for material i.)

Porosity Viscosity Compressibility

Wellbore Radius x y z

The wellbore position describes where the wellbore vector enters the top surface for the vertical/inclined geometry. For the purely horizontal case it describes the heel of the first completed section. It also implies the depth of the wellbore for the horizontal case Inclination Flip Flag The inclination of the wellbore is the angle that it makes with the xy plane. This angle will be assumed to be with the positive sense of that plane. θ has the range $\pi/2$ $-\pi/2$. A binary flag to instruct the system to flip the mesh (0=>NO Flip).

Azimuth

The azimuth is the angle in plan of the wellbore and will always have the range $-\pi/2$ $-\pi/2$.

No. of Completions start point i length i

Constant Pressure boundary binary flags. n+2 flags, where there are n control points. "1" indicates that the edge for which that point is the start point (in an anti-clockwise direction) is a constant pressure boundary. The first two flags pertain to the top and bottom surfaces respectively.

Initial Pressure

This could be assumed as 0, but a realistic value assists simulation.

Sandface Flowrate

After non-dimensionalisation this has no effect, but again a realistic value ensures that the absolute pressures calculated are realistic.

Final Time

This is the extent (in seconds) of the analysis required.

Reference Layer Reference Polygon

If the layer containing the material whose property values are to be used for non-dimensionalisation is given, the system uses the main material of that layer (not damage or radial composite material). The principal x permeability is the permeability chosen. The polygon to be used within that layer is given on the same line.

No. of Interior No-flow Boundaries

Node 1 Node2

Series of interior edges can be defined (lining the control points) such that there will be no flow across that boundary.

All distances, coordinates are in meters (m). Vectors (in the context of strike and dip) and plane coefficients are dimensionless.

The following are the material properties:

Permeability in meters squared ($m^2$),

Porosity is dimensionless,

Viscosity in Pascal seconds (Pa s),

Compressibility in "per Pascal" (/Pa).

All angles are in degrees. Pressure is expressed in Newtons per meter squared ($N/m^2$). Flowrate is expressed in meters cubed per second ($m^3/s$).

This data is inputted to a simulation tool for simulation in step 25. This generates an output pressure curve which is reviewed by the engineer in step 26. The output is then imported into an analysis tool for analysis in step 27. This involves interpretation of the results in the light of the measured data. As a result, there may be feedback to either model modification 23 or simulation 25, as indicated by the steps 28 and 29. These steps provide iteration until the pressure curves match adequately to derive reliable reservoir/payrock data.

The simulation step 25 is illustrated in more detail in FIGS. 4(*a*) and 4(*b*). The data file is imported in step 30 and its integrity is checked in step 31. Step 31 involves checking the geometry for consistency and admissibility with simple verification tests. If the data fails, simulation is stopped in step 32.

If the data passes the check 31, it is used for creation of mesh object generators in step 33. As described above, the model comprises polygons and layers, and the polygons are defined by control points at the corners. The polygons usually define areas of homogenous material properties in a given layer and the layers usually describe physical layers of homogenous materials. The model is used to instantiate various classes as objects for mesh generation. The objects include:

- a mesh object for the full topology and geometry of the reservoir,
- a shape object for the overall reservoir description,
- a polygon object defining each polygon in terms of an aerial region in plan bounded by edges defining vertical planes; and
- a layer object defining each plane bordering the layers.

The objects are interrelated, for example, by the shape object comprising polygon object attributes.

In step 34 these objects are checked for integrity and simulation is stopped in step 35 if they fail. Iterative steps 36 and 37 then generate a finite element mesh from the objects. To generate a mesh, a pattern object is created. This object defines a pattern of elements in a radial line from the wellbore in which the number of elements in the wellbore radial direction is reduced with increasing distance from the wellbore. The pattern object creates elements at the wellbore which conform to the geometric positions of the completion openings and are graded to facilitate numerical convergence of the finite element solution. An example is shown in FIG. 6 which illustrates a wellbore centreline 61 and wellbore flow openings 62. The pattern object defines elements 63 adjoining the wellbore 61, and larger elements 64 at a distance from the wellbore 61.

Relationships between the objects ensure consistency of the mesh. For example, the element boundaries are consistent with the layer boundaries, as shown in FIG. 6. The reduction in the number of elements away from the wellbore reduces the required CPU time for the subsequent finite element formulation and solution.

Relationships between the objects are then used to sweep the pattern through 360° C. as viewed in plan around the wellbore 61, and the extremities are stretched to reach the polygon boundaries. In this way the pattern object is used to generate a mesh of elements for the wellbore polygon. The mesh has the same elevational cross-sectional pattern at any radial line extending from the wellbore, the only differences being length to the polygon boundary from the wellbore. FIG. 6 shows two patterns 66 and 67, one for each of two adjoining polygons having a common boundary 65.

To generate a mesh for the remainder of the model, each of the remaining polygon objects is modified to define each boundary line as either a base line or a generator line. Referring to FIG. 7, a polygon 70 comprises a base line 71 adjoining a polygon 72 and a base line 73 adjoining a polygon 74. The polygons 72 and 74 must also define the lines 71 and 73 as base lines. The polygons also define generator lines and the status of edges common to two polygons is set the same for both. The algorithms to implement these definitions are encapsulated in the shape object. In FIG. 7, the polygon 70 has a generator line 75, the polygon 72 has a generator line 76, and the polygon 74 has a generator line 77.

This object also defines interior generator lines within polygons and parallel to one of the boundary generator lines. These are indicated by the interrupted lines in FIG. 7.

A pattern object along a generator line is generated and it is swept along the adjoining base line as indicated by the arrows A in FIG. 7. Again, the pattern of elements is the same along all generator lines, both boundary and internal, within a polygon. The pattern objects comprise methods (algorithms) and attributes which relate them to each other to ensure coherence between the elements of adjoining polygons. The polygons are ranked according to their relationship with the wellbore polygon. Thus, a level 1 polygon is connected to the wellbore polygon and a level 2 polygon is connected to a level 1 polygon, and so on. Each level has a unique pattern object.

Referring again to FIG. 6, element pattern generation is now described in more detail. In this example, seven levels are generated at the wellbore side such that two correspond exactly to the geometry of the open section and the others are spaced suitably in a manner that will lead to numerical convergenqe of the finite element solution. The two-dimensional diagrams that represent these sections correspond to the diagrammatic representation of the pattern objects used in this approach. In the pattern object, the element is represented as a 2D facet 68. The number of facts 68 used parallel to the wellbore object is automatically reduced as the pattern progresses out radially from the wellbore. This reduction is controlled by specific logic rules that allow the object to "decide" which levels (or layers of facets) can be eliminated without removing the level that corresponds to a material interface in the real reservoir. These rules also provide the logic though which each facet 68 can be completed. When the pattern object is swept in a rotational manner around the wellbore to fill the wellbore polygon space, the elements are created through the rotation of the facets.

Another instance of the same class of object is used in the pattern 67. The match-up between the two patterns is imperative to the production of a conforming finite element mesh This match-up is achieved through the shape object that encapsulates all the polygons of the reservoir description. In essence, each polygon knows the polygons on its boundaries and consequently the patterns that it must match. Again, if there is the possibility of reducing the number of facets 68 (and thus elements) parallel to the wellbore this pattern object applies the same logical rules referred to above. This pattern (and facets) are swept in a translational manner along the baseline(s) of the polygon to fill that polygon space.

It is clear from FIG. 6 that over the extent of the two patterns the number of elements parallel to the wellbore is reduced from seven to three. In more complex examples this reduction is more significant (e.g. from thirty to three would not be unusual). The result of this approach is to reduce the number of elements and nodes that define the mesh, thus reducing the simulation time very significantly.

Finite element simulation then takes place in step 39 using the generated element mesh. The simulation algorithm exploits specific features of the physical problem such as:

layering of geological strata;

localised nature of drilling damage around the wellbore;

remoteness of external boundaries;

compactness of high activity zones in the early transient;

single phase flow towards a single, deviated wellbore;

pressure equality constraints on well-bore flow regions.

An important feature is that the finite element mesh generation, material property assignment and equation solving are inextricably coupled and interdependent. It follows, from the new approach, that variable precedence data, as required in the solution of the equations, may be inferred and constructed within the mesh generation. The restricted class of geometries, material disposition and topology occurring in the simulation leads to optimal precedence data with greatly increased efficiency.

The specific class of well-flow entails a boundary condition on parts of the wellbore. This boundary condition leads to a set of pressure equality constraints which are exploited to re-map the precedence data so as to achieve significant reductions in computation time. Also, the enforcement of these pressure equality constraints significantly improves the accuracy of the computed results and of the correlation with measured data from real petroleum reservoirs.

The efficiency of the simulation is also increased by a number of important algorithmic features which include:

use of a ring-mapped data base;

portrait-mapping of the active equation cluster;

use of a disk storage and retrieval algorithm for equation packets, optimally linked to physical architecture of the computer.

Referring again to FIG. 4(*a*), if there is no review, as indicated by the decision step 40, the results are outputted for analysis in step 41 and simulation is stopped in step 42. Regarding the results, reservoir engineers view the results of an analysis in the form of two dimensionless plots. One is of dimensionless pressure versus dimensionless time. The second is the derivative with respect to log of dimensionless time. Both these curves are generally plotted on a log/log plot. The experienced reservoir engineer can discern features of these plots and relate them to physical phenomena occurring in the reservoir over the period being simulated. This is an essential part of the well-testing process through which the reservoir engineer determines the physical parameters of the reservoir.

The output from the simulation is the data that constitutes these plots. The system also plots these graphs itself as a visual aid to the reservoir engineer. A layout is shown in FIG. 8. In this layout, a regularly shaped reservoir 80 having a constant pressure boundary 81, is split by a zone 82 of low permeability. The wellbore is surrounded by a damage zone 83 of equally low permeability.

The analysis of the welltest problem results in a graph as shown in FIG. 9. This graph reflects the layout modelled as indicated such as:

the effect of the damage zone, the time at which the low permeability zone is reached by the pressure transient, the time at which the outer boundary is reached by the pressure transient, the time at which (and the effect of) the constant pressure outer boundary is reached.

The graph window which is used to plot the results of the analysis serves another purpose in graphical post processing and analysis steps 43 and 41 respectively. In a pressure map mode (i.e. when the perspective view window is used to plot the pressure map) the graph takes on the role of allowing the user to control a number of aspects of that pressure map, namely:

1. The time step history point to be viewed,
2. The minimum dimensionless pressure to be colour mapped, (points with a pressure below this will be shown as grey).
3. The maximum dimensionless pressure to be colour mapped, (points with a pressure above this will be shown as white).

An example is shown in FIG. 10. These parameters are represented on the graph as three lines, two horizontal (minimum dimensionless pressure and maximum dimensionless pressure), and one vertical (current time step for which the pressure map is plotted). The reservoir engineer can drag any of these lines individually on the graph to set it to the desired position. This interface gives the reservoir engineer full control over the plot he is viewing in a simple and effective manner.

It will be appreciated that the invention allows generation of more accurate reservoir data because of accuracy of the reservoir geometrical data. Also, the method of interpreting the models/templates produces a suitable finite element mesh for the analysis of the pressure transient phenomena associated with the reservoir. The approach taken in the invention has important advantages over conventional reservoir testing methods. Currently, well testing involves using analytic solutions to very simplified reservoir models. Aspects like material anisotropy, multiple layers, non parallel bedding planes, aerial heterogeneity, and complex geometry cannot be modelled. The simplifications necessary to simulate real problems limits the accuracy of the analysis. The method and system of the invention can handle all of the above aspects. Another very important aspect is that the invention allows conceptualisation of the reservoir so that mesh generation can take place very quickly, typically in under 20 seconds.

The invention also provides for easy analysis of the results by the reservoir engineer, and because they are based on accurate models the results are generally more meaningful and accurate.

Because of the mesh which is generated complex reservoir configurations may be modelled in minutes rather than hours, and the generated mesh allows optimum use of CPU time.

The invention is not limited to the embodiments described but may be varied in construction and detail within the scope of the claims.

What is claimed is:

1. A hydrocarbon reservoir analysis method comprising the steps of:

modelling a reservoir having a wellbore as a solid model comprising spaces defined by polygons in plan and layers in elevation, the polygons defining areas of homogeneous material properties in a layer, in which at least one of said spaces is a wellbore space containing the wellbore, and in which:

a shape object defines overall reservoir shape, a polygon object defines each polygon in terms of an aerial region in plan bounded by edges defining vertical planes, and a layer object defines each layer in terms of top and bottom bounding planes of the layer;

providing a mesh by generating finite elements in patterns of finite elements in the spaces, in which:

a pattern object generates finite elements to fill said wellbore space by sweeping rotationally in a plane extending radially from the wellbore to the polygon boundaries, and a pattern object is swept translationally within each space other than the wellbore space from a starting plane corresponding to a generator line, and it generates finite elements in a direction extending from the generator line in the direction of an adjoining base line, and in which said generator line coincides with a polygon boundary;

measuring wellface pressure data in the wellbore against time; and simulating hydrocarbon flow from the reservoir into the wellbore using the mesh, and refining the solid model and subsequently the mesh by comparing simulated wellface pressure response with the measured wellface pressure data.

2. A method as claimed in claim 1, wherein the method comprises the further step of selecting an appropriate template solid model from a set of template models and modifying the selected model.

3. A method as claimed in claim 2, wherein the selected model is modified by changing the numbers of layers and the shapes of the polygons.

4. A method as claimed in claim 3, wherein the polygon shapes are modified by changing locations of control points at polygon corners and the number of layers is changed by changing depth data associated with said control points.

5. A method as claimed in claim 1, wherein the model is represented by objects instantiated from classes.

6. A method as claimed in claim 1, wherein the pattern object defines progressively fewer elements as it extends from the wellbore.

7. A method as claimed in claim 1, wherein the base line and the generator line coincide with polygon boundaries.

8. A method as claimed in claim 1, wherein the base and generator lines are defined as such in the shape object, and each pattern object is related to the polygon objects and to the shape object according to a condition that each polygon comprises at least one base line and at least two generator lines.

9. A method as claimed in claim 1, wherein the pattern objects are inter-related in a manner whereby they are ranked according to their relationship with the wellbore space.

10. A method as claimed in claim 9, wherein the wellbore space has a first rank level, spaces adjoining the wellbore polygon have a second rank level, spaces adjoining the second rank spaces have a third rank level, and subsequent spaces are ranked accordingly.

11. A method as claimed in claim 1, wherein the mesh is generated by generating a pattern object defining elements extending in an elevational plane, and each pattern object defines elements according to facets linking layer bounding planes.

12. A method as claimed in claim 1, wherein the simulation is performed according to algorithms which inextricably couple finite element mesh generation, material property assignment, and equation solving.

13. A method as claimed in claim 12, wherein variable precedence data required for equation solution is inferred and constructed within mesh generation.

14. A method as claimed in claim 13, wherein variable precedence data required for equation solution is inferred and constructed within mesh generation, and the simulation imposes boundary conditions on parts of the wellbore, leading to a set of pressure equality constraints used to re-map the precedence data to reduce computation time.

15. A method as claimed in claim 14, wherein the simulation step comprises the sub-steps of representing time step history, minimum dimensionless pressure, and maximum dimensionless pressure as lines in a pressure/time graph providing controls for a colour range, and receiving input instructions in the form of movement of said lines to a desired position.

16. A hydrocarbon reservoir analysis system comprising means for performing a method as claimed in claim 1.

17. A computer program product storing software code for implementation of a method as claimed in claim 1 when executed by a digital computer.

* * * * *